US010960256B2

(12) United States Patent
Donnelly et al.

(10) Patent No.: US 10,960,256 B2
(45) Date of Patent: Mar. 30, 2021

(54) MULTIPURPOSE WORKOUT AND STORAGE BENCH

(71) Applicant: FITBENCH, Oconomowoc, WI (US)

(72) Inventors: John Robert Donnelly, Shorewood, WI (US); Tyler Steven William Danen, Oconomowoc, WI (US); David Thomas Rutledge, Delafield, WI (US)

( * ) Notice: Subject to any disclaimer, the term of this patent is extended or adjusted under 35 U.S.C. 154(b) by 0 days.

(21) Appl. No.: 16/341,894

(22) PCT Filed: Oct. 25, 2017

(86) PCT No.: PCT/US2017/058283

§ 371 (c)(1),
(2) Date: Apr. 13, 2019

(87) PCT Pub. No.: WO2018/081267

PCT Pub. Date: May 3, 2018

(65) Prior Publication Data

US 2019/0240528 A1 Aug. 8, 2019

Related U.S. Application Data

(60) Provisional application No. 62/413,367, filed on Oct. 26, 2016.

(30) Foreign Application Priority Data

Oct. 25, 2017 (WO) ..... PCT/US2017/058283

(51) Int. Cl.
*A63B 21/00* (2006.01)
*A63B 71/00* (2006.01)
(Continued)

(52) U.S. Cl.
CPC ..... *A63B 21/4029* (2015.10); *A63B 71/0036* (2013.01); *B65D 21/0204* (2013.01);
(Continued)

(58) Field of Classification Search
CPC ..... A63B 21/4029; A63B 21/0442; A63B 21/0552; A63B 21/0726; A63B 71/0036;
(Continued)

(56) References Cited

U.S. PATENT DOCUMENTS 2,258,782 A * 10/1941 McKean ..... A61G 13/0018 5/623
4,477,074 A 10/1984 Bushnell
(Continued)

FOREIGN PATENT DOCUMENTS

CA 2280303 A1 2/2001
DE 3744449 A1 7/1989
(Continued)

*Primary Examiner* — Garrett K Atkinson
*Assistant Examiner* — Zachary T Moore
(74) *Attorney, Agent, or Firm* — QuickPatents, Inc.; Kevin Prince

(57) ABSTRACT

A workout bench is disclosed that has rectanguloid front and rear containers each connected with two opposing rectanguloid side containers therebetween. The front and rear containers are least partially open. Each side container is open at an outward, lateral side thereof. The containers are each flush at their top, bottom, and lateral sides. The containers each define an internal storage volume therein, with the front and rear containers accessible from their partially open top sides. The workout bench also has a benchtop pivotally fixed with the front container, with a selectively movable brace for holding the benchtop at one of a plurality of predefined angular positions with respect to the top sides of the containers. A plurality of feet project away from the bottom sides of at least two of the containers.

15 Claims, 6 Drawing Sheets

(51) Int. Cl.

| | |
|---|---|
| ***B65D 21/02*** | (2006.01) |
| ***A63B 21/055*** | (2006.01) |
| ***A63B 21/072*** | (2006.01) |
| ***A63B 21/04*** | (2006.01) |
| ***A63B 71/02*** | (2006.01) |

(52) U.S. Cl.
CPC ..... *A63B 21/0442* (2013.01); *A63B 21/0552* (2013.01); *A63B 21/0726* (2013.01); *A63B 2071/025* (2013.01); *A63B 2210/50* (2013.01); *A63B 2225/682* (2013.01)

(58) Field of Classification Search
CPC ..... A63B 2071/025; A63B 2210/50; A63B 2225/682; B65D 21/0204; B65D 7/02; B65D 7/06; B65D 7/065; B65D 7/08; B65D 7/10; B65D 7/14; B65D 7/34; A47B 31/00; A47B 2031/003; A47B 2031/004; A47B 2031/005; A47B 43/00; A47B 43/04; A47B 82/02; A47B 82/021; A47B 82/0213; A47B 55/00; B62B 3/00
See application file for complete search history.

(56) References Cited

U.S. PATENT DOCUMENTS

| | | | | |
|---|---|---|---|---|
| 5,551,936 | A | 9/1996 | Parisi | |
| 5,575,742 | A * | 11/1996 | Wu | A63B 23/0211 482/142 |
| 5,611,762 | A | 3/1997 | Kaye | |
| 5,772,561 | A | 6/1998 | Hayden | |
| 5,997,442 | A | 12/1999 | Cordes | |
| 6,146,316 | A | 11/2000 | Carolus | |
| 6,245,001 | B1 * | 6/2001 | Siaperas | A63B 21/04 482/123 |
| 6,454,683 | B1 * | 9/2002 | Kaye | A63B 23/035 482/142 |
| 6,634,998 | B2 | 10/2003 | Siaperas | |
| 6,645,130 | B2 | 11/2003 | Webber | |
| 7,134,548 | B2 | 11/2006 | Meehan | |
| 7,311,642 | B2 | 12/2007 | Li | |
| 7,601,101 | B2 | 10/2009 | Jackson | |
| 7,614,988 | B1 * | 11/2009 | Kiser | A63B 21/4029 482/142 |
| 7,651,452 | B2 | 1/2010 | Weir | |
| 7,731,639 | B1 | 6/2010 | Shifferaw | |
| 7,914,424 | B1 | 3/2011 | Krull | |
| 3,403,134 | A1 | 3/2013 | Kantgias | |
| 8,550,243 | B2 | 10/2013 | Moore | |
| 8,715,144 | B1 | 5/2014 | Friess | |
| 9,022,907 | B2 | 5/2015 | Wang | |
| 9,308,409 | B2 | 4/2016 | Beaver | |
| 9,308,410 | B2 | 4/2016 | Beaver | |
| 9,770,618 | B2 | 9/2017 | Wall | |
| 10,092,791 | B2 * | 10/2018 | Donnelly | B65D 21/0204 |
| 10,427,702 | B2 * | 10/2019 | Phillips | B62B 5/064 |
| 10,576,352 | B2 * | 3/2020 | Vester | A63B 21/4029 |
| 2002/0105156 | A1 | 8/2002 | Glidden | |
| 2003/0109364 | A1 | 6/2003 | Weir | |
| 2003/0186786 | A1 | 10/2003 | Hsu | |
| 2004/0014570 | A1 | 1/2004 | Centopani | |
| 2005/0037905 | A1 | 2/2005 | Matos | |
| 2006/0100074 | A1 | 5/2006 | Murdoch | |
| 2006/0293156 | A1 | 12/2006 | Trees | |
| 2007/0164525 | A1 * | 7/2007 | Rodrigues | A45C 7/0054 280/47.18 |
| 2007/0270292 | A1 * | 11/2007 | Laney | A63B 21/4035 482/121 |
| 2008/0023355 | A1 | 1/2008 | Reynolds | |
| 2008/0185805 | A1 | 8/2008 | Chen | |
| 2009/0065457 | A1 | 3/2009 | Kostigian | |
| 2009/0230644 | A1 * | 9/2009 | Stanley | B62B 5/049 280/43 |
| 2011/0263397 | A1 | 10/2011 | Jackson | |
| 2012/0248047 | A1 | 10/2012 | Tanabe | |
| 2013/0213917 | A1 | 8/2013 | Rios Garcia Prieto | |
| 2014/0027223 | A1 | 1/2014 | Moore | |
| 2014/0243174 | A1 | 8/2014 | Alenaddaf | |
| 2015/0328494 | A1 | 11/2015 | Matthews | |
| 2016/0001116 | A1 | 1/2016 | Prusaitis | |
| 2016/0059104 | A1 | 3/2016 | Monaco | |
| 2018/0133538 | A1 | 5/2018 | Jones | |

FOREIGN PATENT DOCUMENTS

| | | |
|---|---|---|
| DE | 20212161 | 1/2003 |
| DE | 20215421 | 3/2003 |
| GB | 2181658 A | 4/1987 |
| GB | 2475567 A | 5/2011 |
| WO | 2013072945 A1 | 5/2013 |

* cited by examiner

MULTIPURPOSE WORKOUT AND STORAGE BENCH

CROSS-REFERENCE TO RELATED APPLICATIONS

This application claims the benefit of PCT Patent Application PCT/US2017/058283, filed on Oct. 25, 2017 with a priority date of Oct. 26, 2016, which claims priority to U.S. patent application Ser. No. 15/786,515 filed on Oct. 17, 2017, now U.S. Pat. No. 10,092,791 issued on Oct. 9, 2018, which claims priority to U.S. Provisional Application 62/413,367, filed on Oct. 26, 2016; all hereby incorporated herein by reference.

STATEMENT REGARDING FEDERALLY SPONSORED RESEARCH AND DEVELOPMENT

Not Applicable.

FIELD OF THE INVENTION

This invention relates to fitness equipment, and more particularly to a workout bench adapted to be relatively compact, easily moveable, highly portable, adjustable for performing exercises suitable to work out every part of the body, and equipped for the efficient storage and use of a variety of specialized exercise equipment.

BACKGROUND

The prior art includes: U.S. Pat. No. 6,454,683 (Sep. 9, 2002); U.S. Pat. No. 7,614,988 (Nov. 10, 2009); U.S. Pat. No. 7,311,642 (Dec. 25, 2007); U.S. Patent Application No. 20040014570 (Jan. 22, 2004); U.S. Pat. No. 4,477,074 (Oct. 16, 1984); U.S. Pat. No. 5,997,442 (Dec. 7, 1999); and U.S. Patent Application No. 20110263397 (Oct. 27, 2011). It is desirable to have an improved workout bench that is superior to any that is disclosed or suggested in the identified references.

SUMMARY OF THE INVENTION

The present device is a workout bench for use by a person on a support surface and for holding a plurality of exercise items. The workout bench comprises a rectanguloid front container and a rectanguloid rear container each connected with two opposing rectanguloid side containers therebetween. The front container is at least partially open at a front side thereof, and the rear container is at least partially open at a rear side thereof. Each side container is open at an outward, lateral side thereof. The front container, the rear container, and the side containers are each flush at the top sides thereof, bottom sides thereof, and lateral sides thereof. Preferably, at least one bottle holder is fixed with at least one of the front container, the rear container, or the side containers. The front container, rear container, and side containers each define an internal storage volume therein. Preferably, the front container further includes a first side door in at least one of the lateral sides thereof, the first side door being positionable between an open position for accessing the internal storage volume, and a closed position.

The workout bench further comprises a benchtop pivotally fixed with the front container and including a selectively movable brace for holding the benchtop at one of a plurality of predefined angular positions with respect to the top sides of the front container, the rear container, and the side containers. Preferably, a trough is defined between the side containers and flush with the top sides thereof. The trough contains a raised beam having a plurality of transverse notches formed in a top side thereof. In this configuration, the movable brace of the benchtop includes a cross bar adapted to fit within any of the notches, whereby each of the predefined angular positions of the benchtop correspond with the cross bar being engaged with one of the notches of the trough. The rearmost notch corresponds with the benchtop lying flat on the front container, the rear container, and the side containers, and with the brace being fully contained within the trough.

In addition, it is preferable that the top sides of the front container and the rear container are at least partially open, whereby when the benchtop is lifted upwardly away from the front container and rear container, the storage volumes of the front container and rear container become accessible from the top sides thereof. The internal storage volume of the front container preferably includes a rear compartment isolated from the open front side of the front container by a dividing wall. In this configuration, the at least partially open front side of the front container includes a plurality of container baskets, which may be used to store exercise items. The rear compartment may further be accessible through the open top side of the front container or the front container's first side door in the open position. The exercise items may include but are not limited to dumbbell-type exercise items, resistance band-type exercise items, and kettle-bell-type exercise items. Each side container preferably further includes a plurality of dumbbell supports fixed with a back wall thereof, whereby the dumbbell-type exercise items may be supported on any of the dumbbell supports and removed from or returned to the side container through the open lateral side thereof.

Preferably, a pair of wheels is fixed with the front container proximate the bottom side and front side thereof, and a handle is fixed with the rear container proximate the bottom side and the rear side thereof. In use, the wheels do not make contact with the support surface when the workout bench is supported by the feet on the support surface. However, when the workout bench is lifted by the handle, the wheels make contact with the support surface, the feet being lifted away from the support surface. Thus, the workout bench is thereby rollable on the support surface.

A plurality of feet project away from the bottom sides of at least two of the front container, rear container and side containers. The feet are adapted for high-friction engagement with the support surface. When the workout bench is in use, the exercise items are placed into the front container, the rear container, and the side containers and the person is supported by the benchtop while performing exercises. Preferably, at least one of the front container, rear container, or side containers is adapted to hold the resistance band-type exercise items, and the workout bench further includes a plurality of eye hooks fixed with at least one of the front container, rear container, or side containers. Thus, one of the resistance band-type exercise items may be removed from its front container, rear container, or side container and fixed with one of the eye hooks so that the person can perform resistance band-type exercises with the workout bench firmly weighted down by the remaining exercise items and immobile on the support surface. The workout bench also preferably further includes a scoop arrangement on the rear side of the rear container, projecting away from the rear side thereof. The scoop arrangement is adapted for urging large exercise items into the rear container.

The present workout bench is compact, portable, easy to move, fully integrated and fully adjustable. This workout bench makes it easy for the user to conduct a complete program of exercise in an efficient amount of time by including storage space for various types of necessary specialized equipment. It allows the user to position the various components of the workout bench in the optimal position for any exercise, and to store and to use whatever equipment is necessary, to exercise the entire body effectively. Further, the workout bench's portable, compact nature allows it to be stored easily in space-restricted homes, and easily moved around within the home or even to a new dwelling. Moreover, the workout bench saves users great amounts of time and money by eliminating the need for a fitness services provider, and prevents unsightly displays and potential falling and tripping hazards by minimizing the entire workout system's footprint when not in use through highly adaptable internal storage. Finally, the storage features also make it very easy for someone to move the workout bench and all their exercise equipment at the same time. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
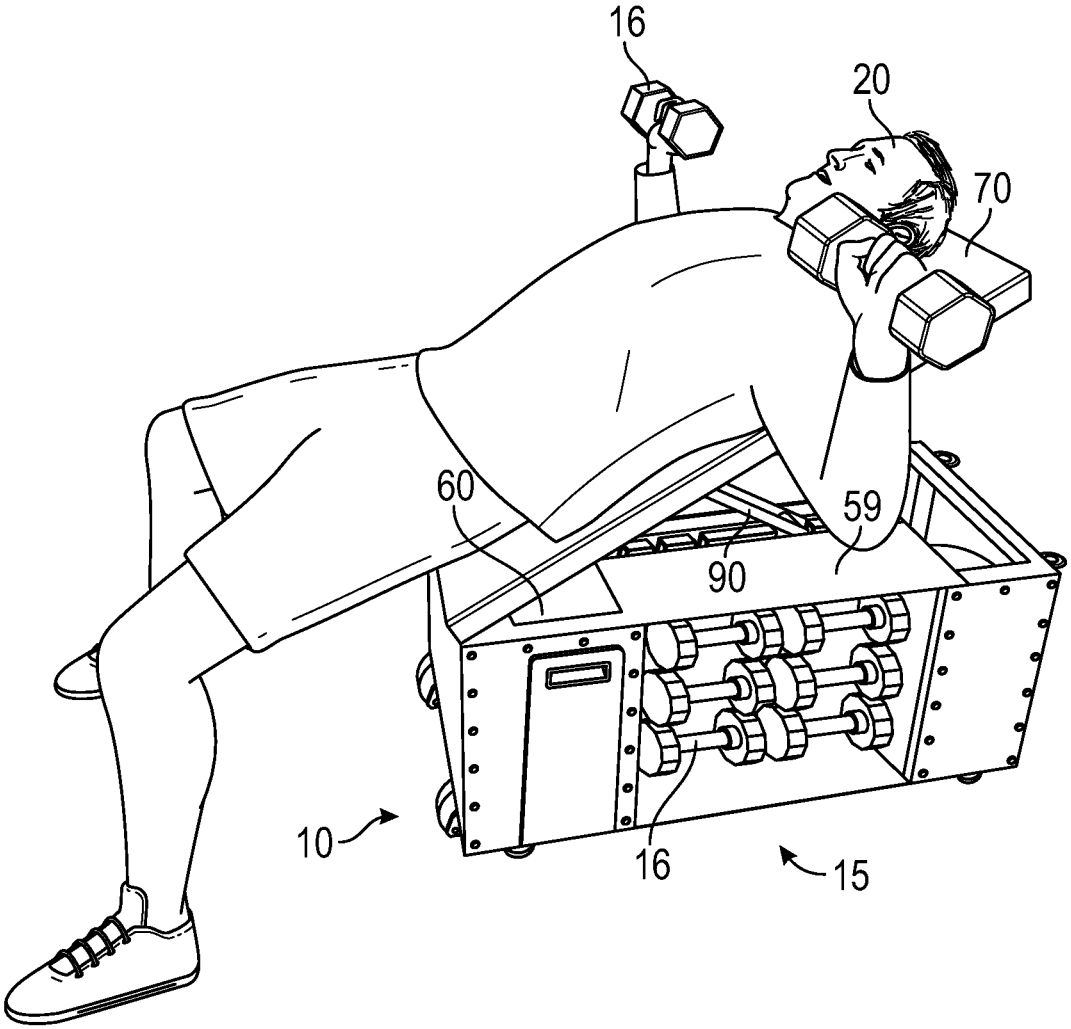
FIG. 1 is a side perspective view of one embodiment of the invention, shown in use by a person with a bench top of the invention in an inclined position.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. Finally, "Detailed Description" refers to this Detailed Description of the Preferred Embodiment.

FIGS. 1-6 illustrate a workout bench 10 for use by a person 20 on a support surface 15 (such as a floor) and for holding a plurality of exercise items 16. The workout bench 10 comprises a rectanguloid front container 30 and a rectanguloid rear container 40 each connected with two opposing rectanguloid side containers 50 therebetween. The front container 30 is at least partially open at a front side 32 thereof, and the rear container 40 is at least partially open at a rear side 48 thereof. Each side container 50 is open at an outward, lateral side 55 thereof. The front container 30, the rear container 40, and the side containers 50 are each flush at the top sides 39, 49, and 59 thereof, bottom sides 31, 41, and 51 thereof, and lateral sides 35, 45, and 55 thereof. Preferably, at least one bottle holder 190 (FIG. 1) is fixed with at least one of the front container 30, the rear container 40, or the side containers 50. The front container 30, rear container 40, and side containers 50 each define an internal storage volume 60 therein. Preferably, the front container 30 further includes a first side door 130 (FIGS. 1-4) in at least one of the lateral sides 35 thereof, the first side door 130 being positionable between an open position 150 for accessing the internal storage volume 60, and a closed position 160. The containers 30,40,50 are made from a rigid material such as steel or aluminum, and may be integrally formed or separately formed and fixed together with mechanical fasteners (not shown).

Figure 9:
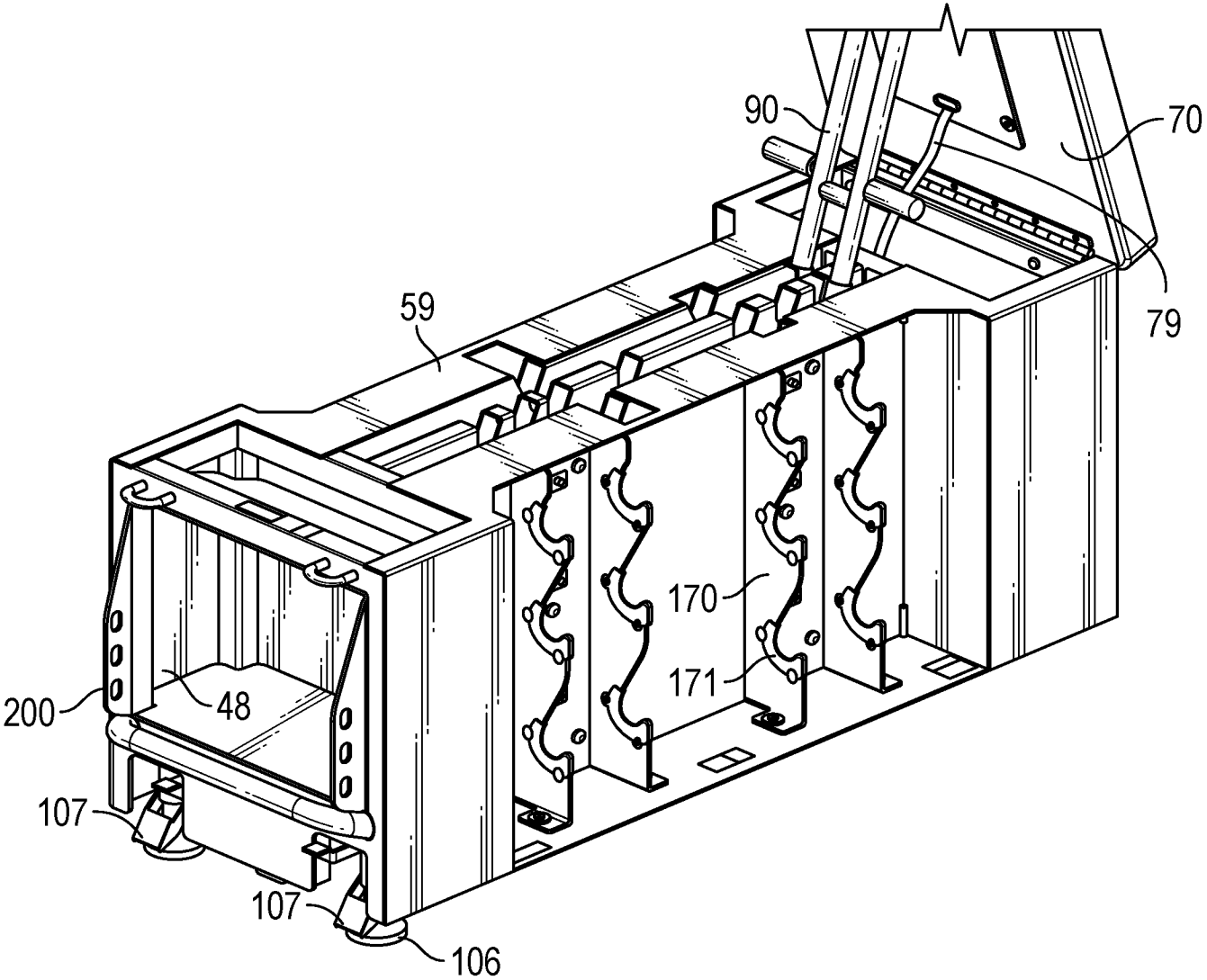
FIG. 9 is a partial top perspective view of an alternate embodiment of the invention, showing the benchtop in an open position.

The workout bench 10 further comprises a benchtop 70 (FIGS. 1-4) pivotally fixed with the front container 30 and including a selectively movable brace 90 (FIG. 1) for holding the benchtop 70 at one of a plurality of predefined angular positions with respect to the top sides 39, 49, and 59 of the front container 30, the rear container 40, and the side containers 50. Optionally, when the benchtop 70 is resting flush against the top sides 39, 49, and 59 of the front container 30, the rear container 40, and the side containers 50, a latch 71 (FIG. 1) may be engaged to lock the benchtop 70 in this position. An optional cushion 80 (FIGS. 1-4) may be permanently affixed to the benchtop 70, covering the entirety of the surface of the benchtop 70 that supports the person 20 when the workout bench 10 is in use. An optional stop strap 79 may be included to prevent the benchtop 70 from being overextended (FIG. 9). An optional pneumatic cylinder (not shown) may be included so that the benchtop 70 closes relatively slowly when released, due to air pressure in the pneumatic cylinder being gradually released by the cylinder.

Preferably, a trough 240 (FIG. 1) is defined between the side containers 50 and flush with the top sides 59 thereof. The trough 240 contains a raised beam 250 having a plurality of transverse notches 260 formed in a top side 258 thereof. In this configuration, the movable brace 90 of the benchtop 70 includes a cross bar 95 adapted to fit within any of the notches 260, whereby each of the predefined angular positions of the benchtop 70 correspond with the cross bar 95 being engaged with one of the notches 260 of the trough 240. The rearmost notch 260 corresponds with the benchtop 70 lying flat on the front container 30, the rear container 40, and the side containers 50, and with the brace 90 being fully contained within the trough 240. As such, during use with the benchtop 70 in an inclined position (FIG. 1), the person 20 must at least partially support himself on the support surface 15.

Figure 3:
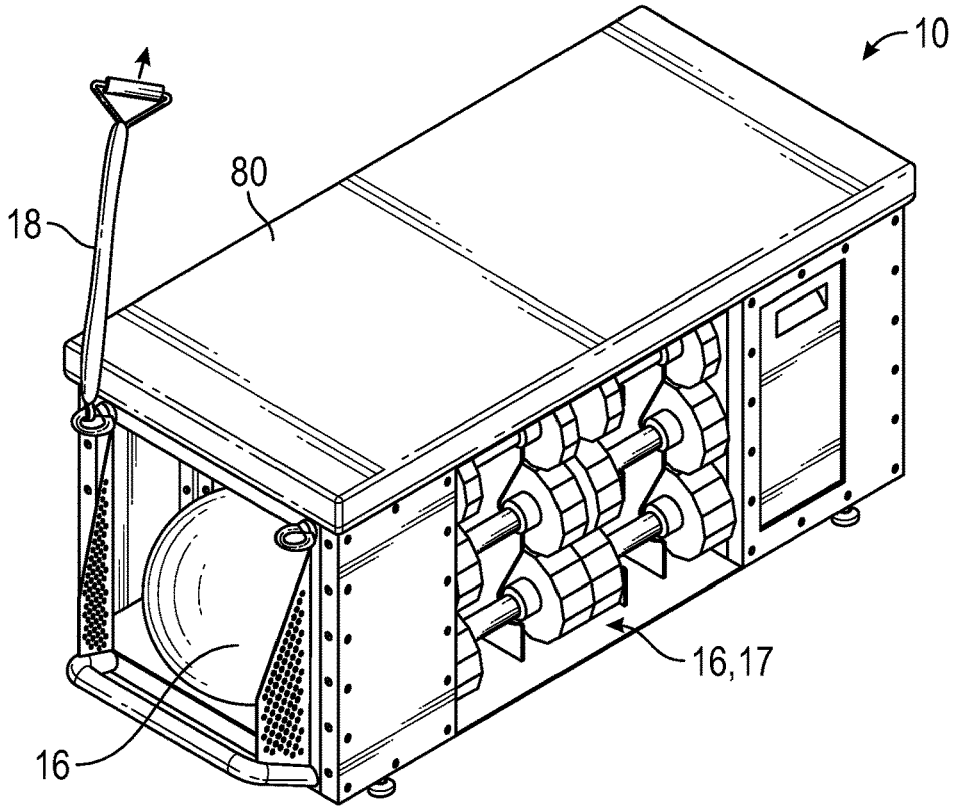
FIG. 3 is an alternate rear perspective view of the invention, illustrated with the bench top in a lowered position, a resistance band attached to an attachment point of the invention, and with the device storing an exercise ball and weights.

In addition, it is preferable that the top sides 39 and 49 of the front container 30 and the rear container 40 are at least partially open, whereby when the benchtop 70 is lifted upwardly away from the front container 30 and rear container 40, the storage volumes 60 of the front container 30 and rear container 40 become accessible from the top sides 39 and 49 thereof (FIG. 1). Whether a particular embodiment includes only the partially open top side 39 of the front container 30, or also additionally includes the first side door 130, the internal storage volume 60 of the front container 30 preferably includes a rear compartment 210 (FIGS. 1, 3) isolated from the open front side 32 of the front container 30 by a dividing wall 220 (FIGS. 1, 3). In this configuration, the at least partially open front side 32 of the front container 30 includes a plurality of container baskets 230 (FIG. 3), which may be used to store exercise items 16. Depending on the embodiment, the rear compartment 210 is accessible through the open top side 39 of the front container 30, or if it is present, the front container 30's first side door 130 in the open position 160.

The exercise items 16 may include but are not limited to dumbbell-type exercise items 17 (FIGS. 2-3), resistance band-type exercise items 18 (FIG. 2), and kettle-bell-type exercise items (not shown). Compatible dumbbell-type exercise items 17 include adjustable dumbbells with characteristics similar to the Bowflex® SelectTech® 552 (not shown) and Powerblock® U-70 and U-90 sets (not shown), or the like. Compatible resistance band-type exercise items 18 include simple elastic bands, TRX® Suspension Training® products (not shown), and similar equipment.

Each side container 50 preferably further includes a plurality of dumbbell supports 170 fixed with a back wall 54 thereof (FIG. 1), whereby the dumbbell-type exercise items 17 may be supported on any of the dumbbell supports 170 and removed from or returned to the side container 50 through the open lateral side 55 thereof.

Figure 7:
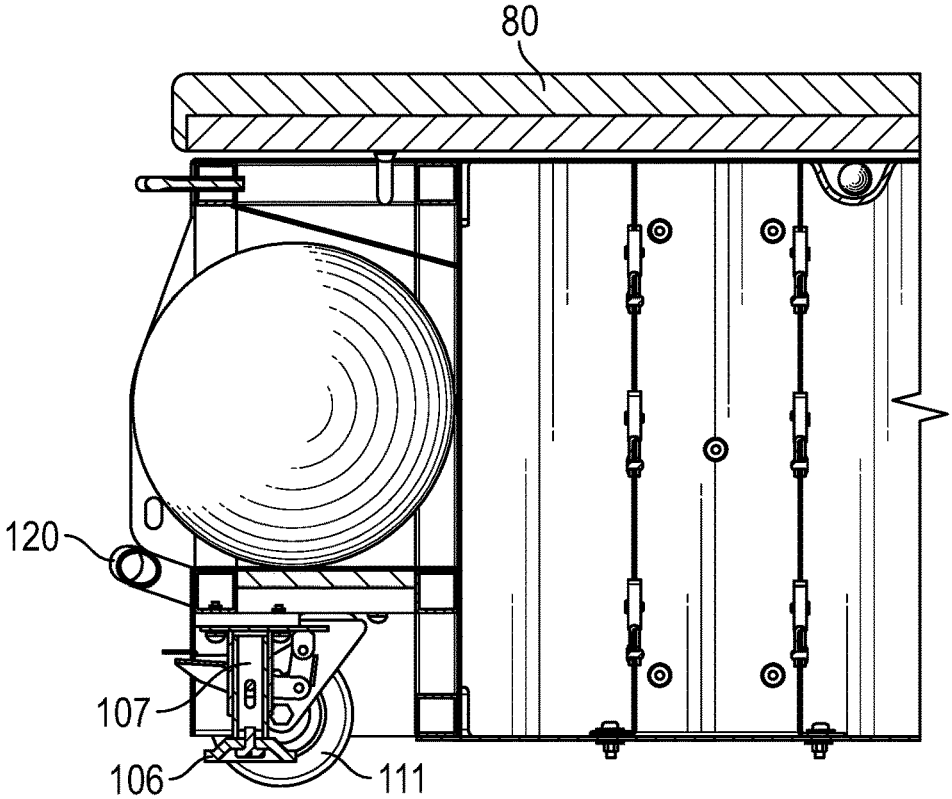
FIG. 7 is a partial side elevational view of an alternate embodiment of a pivotal coaster and a foot extension mechanism of the invention.
Figure 8:
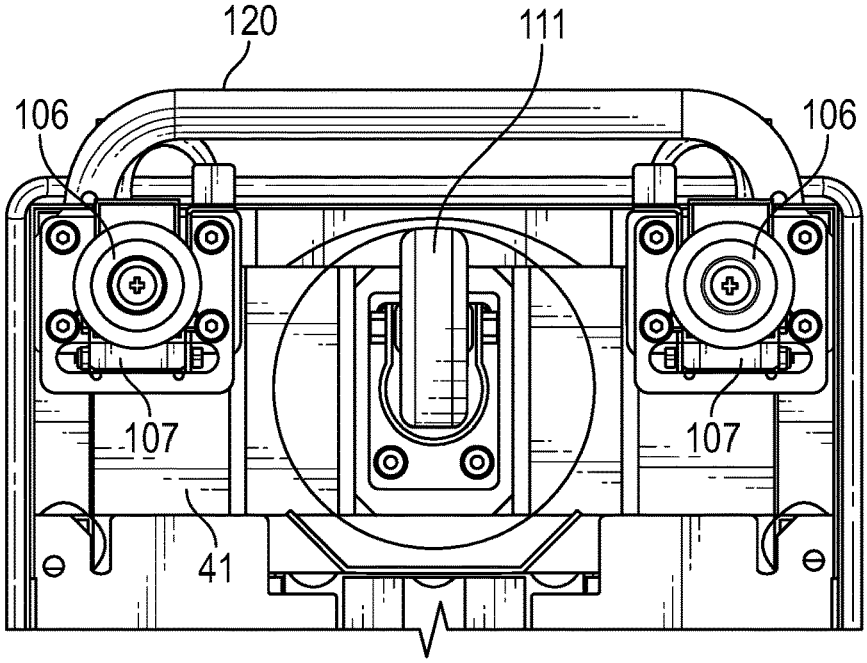
FIG. 8 is a partial bottom plan view of the embodiment of FIG. 7.

Preferably, a pair of wheels 110 (FIGS. 3-4) is fixed with the front container 30 proximate the bottom side 31 and front side 32 thereof. In embodiments featuring the wheels 110, a handle 120 (FIGS. 1-2, 4) is fixed with the rear container 40 proximate the bottom side 41 and the rear side 48 thereof. In use, the wheels 110 do not make contact with the support surface 15 when the workout bench 10 is supported by the feet 100 on the support surface 15. However, when the workout bench 10 is lifted by the handle 120, the wheels 110 make contact with the support surface 15, the feet 100 being lifted away from the support surface 15. Thus, the workout bench 10 is thereby rollable on the support surface 15. Alternately, the rear container 40 may include a pivotal castor 111 such that the workout bench 10 may be rolled around on the support surface 15. In such an embodiment, the feet 100 may include a foot extension mechanism 107 (FIGS. 7-9) that, when actuated, extend an extendable foot 106 beyond the pivotal castor 111 to fix the workout bench 100 to the support surface 15 by friction.

Optionally, a plurality of feet 100 (FIGS. 1-4) project away from the bottom sides 31,41, and 51 of at least two of the front container 30, rear container 40 and side containers 50. The feet 100 are adapted for high-friction engagement with the support surface 15. For example, in one embodiment, a rubber pad 105 (FIG. 1) is permanently affixed to each of the feet 100 such that the rubber pad 105 engages with the support surface 15. Alternately, a high-friction material (not shown) may be applied to the bottom surfaces 31,41,51 of at least one of the containers 30,40,50.

Figure 2:
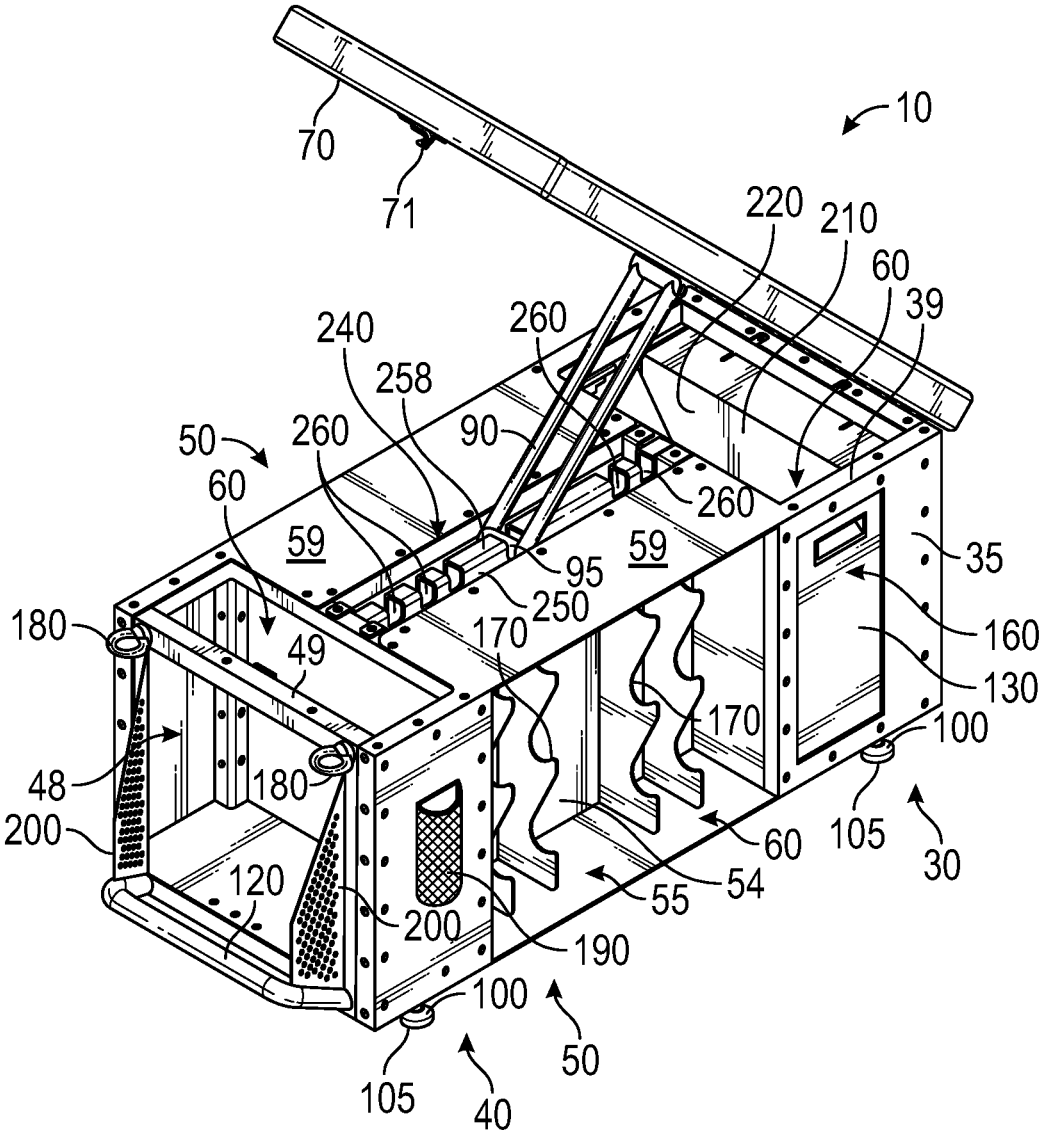
FIG. 2 is a rear perspective view of FIG. 1 with the person omitted.

When the workout bench 10 is in use, the exercise items 16 are placed into the front container 30, the rear container 40, and the side containers 50 and the person 20 is supported by the benchtop 70 while performing exercises. Preferably, at least one of the front container 30, rear container 40, or side containers 50 is adapted to hold the resistance band-type exercise items 18, and the workout bench 10 further includes a plurality of eye hooks 180 or similar attachment structure fixed with at least one of the front container 30, rear container 40, or side containers 50 (FIGS. 1-3). Thus, one of the resistance or suspension band-type exercise items 18 may be removed from its front container 30, rear container 40, or side container 50 and fixed with one of the eye hooks 180 so that the person 20 can perform resistance band-type exercises with the workout bench 10 firmly weighted down by the remaining exercise items 16 and immobile on the support surface 15.

Figure 4:
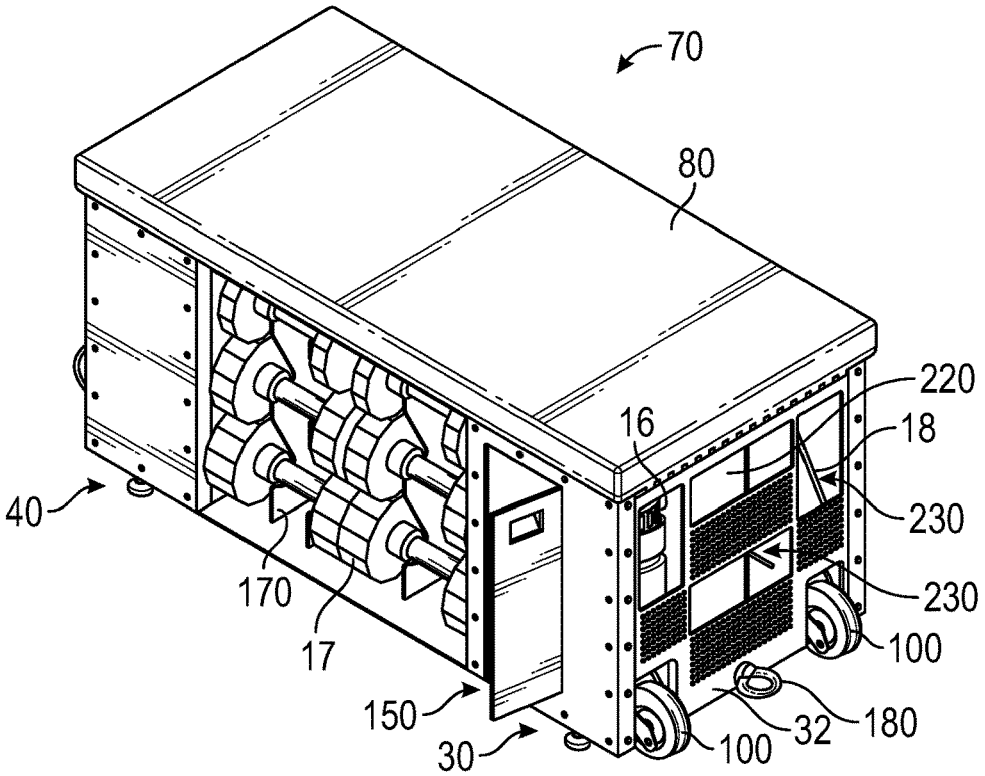
FIG. 4 is a front perspective view of the invention, illustrating a door of a first container thereof in an open position.
Figure 5:
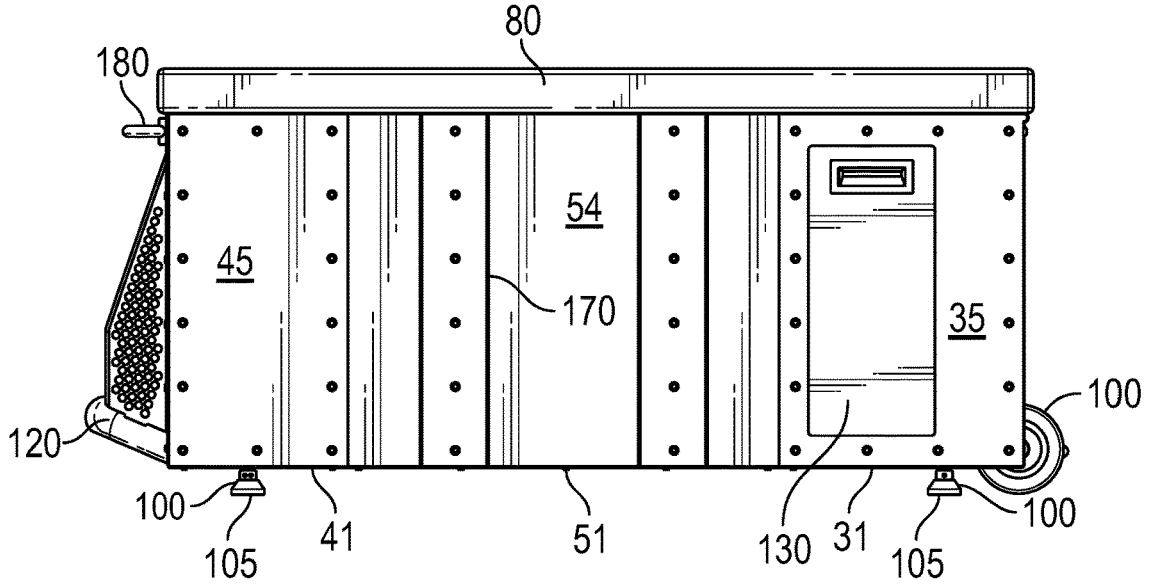
FIG. 5 is a side elevational view of the invention.
Figure 6:
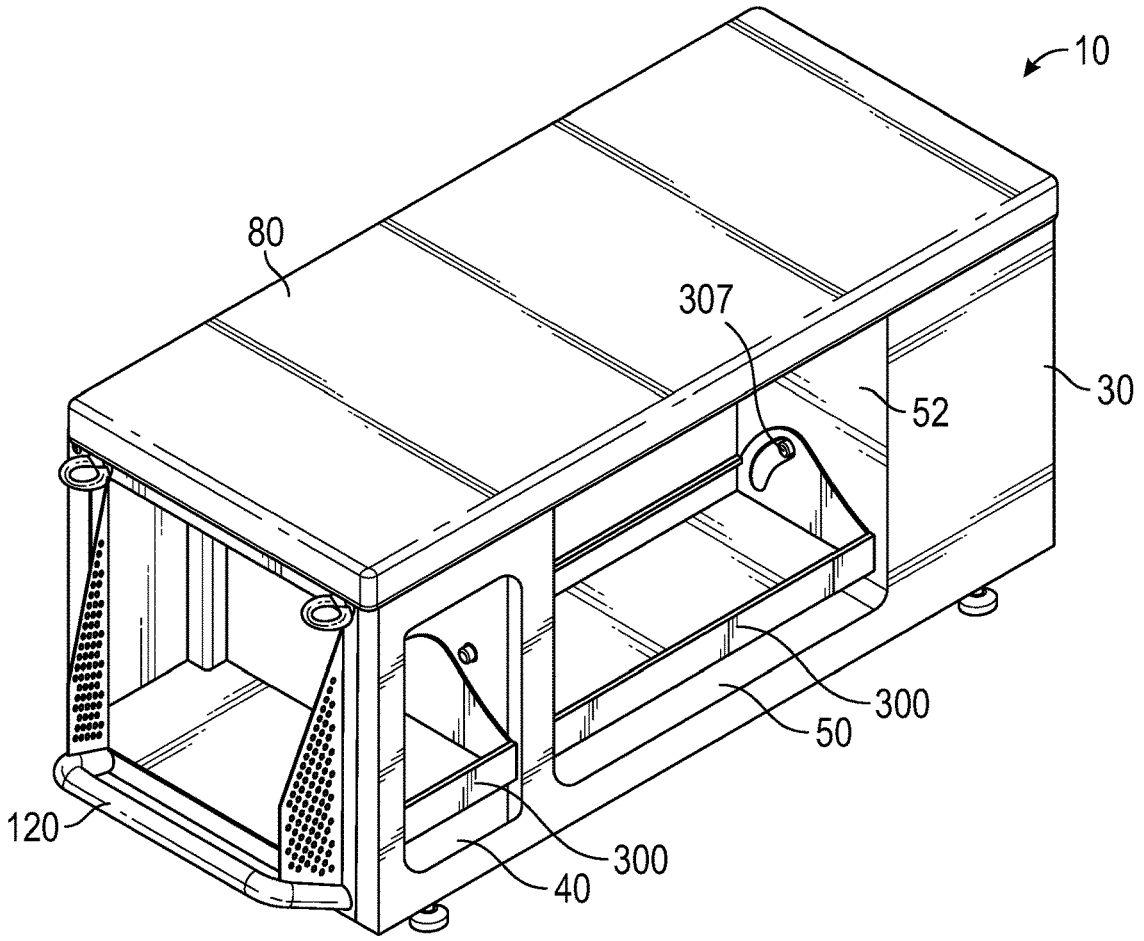
FIG. 6 is a rear perspective view of an alternate embodiment of the invention that includes a pivoting shelf suitable for use with a kettle-bell type weight.

The workout bench 10 also preferably further includes a scoop arrangement 200 (FIGS. 1-2, 4). In one embodiment (not shown), the scoop arrangement is included on the front side 32 of the front container 30, projecting away from the front side 32 thereof. In another embodiment, the scoop arrangement 200 is included on the rear side 48 of the rear container 40, projecting away from the rear side 48 thereof. In any embodiment, the scoop arrangement 200 is adapted for urging large exercise items 16, such as an exercise ball (FIG. 3) or the like, into whichever of the front container 30 or rear container 40 that includes it.

Optionally, either of the side containers 50 may be adapted to include a kettle-bell tray 300 (FIG. 6), for storage of at least one kettle-bell (not shown) or other exercise items, pivotally fixed to the side walls 52. At least one of the side walls 52 includes a protrusion 302. The protrusion 302 fits into a groove 307 formed into the kettle-bell tray 300. When the kettle-bell tray 300 is rotated outward from the side container 50 to receive the kettle-bell, the protrusion 302 moves inside the groove 307 which limits the angular range of the kettle-bell tray 300. Alternately the kettle-bell tray 300 may be slidably mounted on drawer sliders (not shown), or the like.

While a particular form of the invention has been illustrated and described, it will be apparent that various modifications can be made without departing from the spirit and scope of the invention. For instance, various cushions 80 may be used, such as those made from Plastazote® or another high-density foam, and those covered in leather, vinyl, or neoprene, and the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A workout bench for use by a person on a support surface and for holding a plurality of exercise items including at least exercise weights, the workout bench comprising:

a front container and a rear container each connected with two opposing side containers therebetween, the side containers each comprising at least a back wall extending along an inward, lateral side of the side container, the front container at least partially open at a front side thereof, the rear container at least partially open at a rear side thereof, each side container open at an outward, lateral side thereof, the containers each flush at top sides thereof, bottom sides thereof, and lateral sides thereof, each container defining an internal storage volume therein, each side container separated from the other side container, by way of at least the back wall, such that the internal storage volume of each side container is inaccessible from within the internal storage volume of the other side container; and a benchtop fixed with the front container;

whereby the exercise items are placed into the containers and the person is supported by the benchtop while performing exercises;

wherein each side container further includes a plurality of weight supports fixed with the back wall thereof, whereby the weight supports are configured to support one or more of the exercise weights and the side containers are each configured for removing of or returning of the exercise weights through the open lateral side thereof.

2. The workout bench of claim 1 further including a plurality of feet projecting away from the bottom sides of at least two of the containers and adapted for high-friction engagement with the support surface.

3. The workout bench of claim 2 further including a pair of wheels fixed with the front container proximate the bottom and front sides thereof, and further including a handle fixed with the rear container proximate the bottom and rear sides thereof;

whereby the wheels do not make contact with the support surface when the workout bench is supported by the feet on the support surface, but when the workout bench is lifted by the handle the wheels make contact with the support surface, the feet being lifted away from the support surface, the workout bench thereby being rollable on the support surface.

4. The workout bench of claim 1 wherein the benchtop is pivotally fixed with the front container and includes a selectively movable brace for holding the benchtop at one of a plurality of predefined angular positions with respect to the top sides of the containers, the top sides of the front and rear containers being at least partially open, whereby when the benchtop is lifted upwardly away from the front and rear containers, the internal storage volumes of the front and rear containers become accessible from the top sides thereof.

5. The workout bench of claim 4 wherein the front container includes a rear compartment isolated from the open front side of the front container by a dividing wall, the at least partially open front side of the front container including a plurality of container baskets, the rear compartment accessible through the open top side of the front container.

6. The workout bench of claim 4 wherein a trough is defined between the side containers and flush with the top sides thereof, the trough containing a raised beam having a plurality of transverse notches formed in a top side thereof, the movable brace of the benchtop including a cross bar adapted to fit within any of the notches, whereby each of the predefined angular positions of the benchtop correspond with the cross bar being engaged with one of the notches of the trough, the rearmost notch corresponding with the benchtop lying flat on the containers and with the brace fully contained within the trough.

7. The workout bench of claim 1 wherein the front container further includes a first side door in at least one of the lateral sides thereof, the first side door being positionable between an open position for accessing the internal storage volume, and a closed position.

8. The workout bench of claim 7 wherein the front container includes a rear compartment isolated from the open front side of the front container by a dividing wall, the at least partially open front side of the front container including a plurality of container baskets, the rear compartment accessible when the first side door is in the open position.

9. The workout bench of claim 1 wherein at least one of the containers is adapted to hold resistance band-type exercise items, the workout bench further including a plurality of eye hooks fixed with at least one of the containers, whereby one of the resistance band-type exercise items is removed from its container and fixed with one of the eye hooks so that the person can perform resistance band-type exercises, the workout bench firmly weighted down by the remaining exercise items and immobile on the support surface.

10. The workout bench of claim 1 further including at least one bottle holder fixed with at least one of the containers.

11. The workout bench of claim 1 wherein the rear side of the rear container includes a scoop arrangement projecting away from the rear side thereof, the scoop arrangement adapted for urging large exercise items into the rear container.

12. The workout bench of claim 1 further including:

a pair of wheels fixed with the front container proximate the bottom and front sides thereof, and a pivotal castor fixed with the rear container proximate the bottom and rear sides thereof;

a plurality of feet projecting away from the bottom sides of at least two of the containers and adapted for high-friction engagement with the support surface, each foot including a foot extension mechanism configured to be selectively extendable beyond the pivotal castor to fix the workout bench to the support surface by friction of the feet, the foot extension mechanism configured to be selectively retractable so that the workout bench is supported by the wheels and pivotal castor, the workout bench thereby being rollable on the support surface.

13. The workout bench of claim 1 wherein the benchtop is pivotally fixed with the front container and includes a selectively movable brace for holding the benchtop at one of a plurality of predefined angular positions with respect to the top sides of the containers.

14. A workout bench for use by a person on a support surface and for holding a plurality of exercise items including at least kettle-bell type weights, the workout bench comprising:

a front container and a rear container each connected with two opposing back walls to define a pair of opposing side containers between the front container and the rear container, the front container at least partially open at a front side thereof, each side container open at both lateral sides thereof, the containers each flush at top sides thereof, bottom sides thereof, and lateral sides thereof, each container defining an internal storage volume therein; and a benchtop fixed with the front container;

whereby the exercise items are placed into the containers and the person is supported by the benchtop while performing exercises;

wherein each side container further includes a kettle-bell tray pivotally fixed with the front container and rear container, whereby each kettle-bell tray is configured to support one or more of the kettle-bell type weights and the side containers are each configured for removing of or returning of the kettle-bell type weights through the open lateral side thereof.

15. A workout bench for use by a person on a support surface and for holding at least exercise weights, the workout bench comprising:

a front portion including at least a front container defining an internal storage volume therein, the front container being at least partially open at a front side thereof;

a rear portion disposed opposite the front portion;

two opposing side containers disposed between the front and rear portions, the side containers each including at least a back wall extending along an inward, lateral side of the side container, each side container further being open along an outward, lateral side thereof, each side container defining an internal storage volume therein, each side container being separated from the other side container, by way of at least the back wall, such that the internal storage volume of each side container is inaccessible from within the internal storage volume of the other side container; and a benchtop fixed with at least the front portion;

whereby the person is supported by the benchtop while performing exercises;

wherein at least one of the side containers further includes a plurality of weight supports fixed with the back wall thereof, whereby the weight supports are configured to support one or more of the exercise weights and the side containers are each configured for removing of or returning of the exercise weights through the open lateral side thereof.

* * * * *